US005140772A

United States Patent [19]

Pozzi

[11] Patent Number: 5,140,772

[45] Date of Patent: Aug. 25, 1992

[54] WINDOW REGULATOR, PARTICULARLY FOR MOTOR VEHICLES

[75] Inventor: Giuseppe Pozzi, Torino, Italy

[73] Assignee: Roltra Morse S.p.A., Casine Civa-Rivoli, Italy

[21] Appl. No.: 727,597

[22] Filed: Jul. 9, 1991

[30] Foreign Application Priority Data

Jul. 10, 1990 [IT] Italy ..... 67517 A/90

[51] Int. Cl.[5] ..... E05F 11/44

[52] U.S. Cl. ..... 49/350; 49/349; 49/363

[58] Field of Search ..... 49/358, 349, 351, 363

[56] References Cited

U.S. PATENT DOCUMENTS

| | | | |
|---|---|---|---|
| 2,145,659 | 1/1939 | Lane | 49/350 X |
| 2,311,972 | 2/1943 | Simpson | 49/349 X |
| 2,547,851 | 3/1951 | Brundage | 268/124 |
| 2,641,468 | 6/1953 | Jackson | 49/349 |
| 3,591,982 | 7/1971 | Nantau | 49/350 X |
| 4,353,185 | 10/1982 | Saigne | 49/349 X |

FOREIGN PATENT DOCUMENTS

| | | | |
|---|---|---|---|
| 1223715 | 8/1966 | Fed. Rep. of Germany | 49/350 |
| 3330249 | 3/1985 | Fed. Rep. of Germany . | |
| 2012726 | 3/1970 | France . | |
| 2359954 | 2/1978 | France . | |
| 2455667 | 11/1980 | France . | |

*Primary Examiner*—Philip C. Kannan

*Attorney, Agent, or Firm*—Shlesinger, Arkwright & Garvey

[57] ABSTRACT

A window regulator having a first guide, defining the route of a sliding window, is engaged in sliding manner by a first slide connected to the window and moved along the first guide by an actuating device having an actuating arm turning about a first axis lying substantially crosswise in relation to the first guide. A portion of the actuating arm defines a second guide extending along a second axis lying substantially crosswise in relation to the first axis and the first guide; and a second slide, supported on the first slide, is connected in sliding manner to the second guide.

20 Claims, 4 Drawing Sheets

WINDOW REGULATOR, PARTICULARLY FOR MOTOR VEHICLES

BACKGROUND OF THE INVENTION

The present invention relates to a window regulator, particularly for motor vehicles.

In particular, the present invention relates to a window regulator suitable for placement inside the door of a motor vehicle for enabling troublefree, noisefree vertical control of a sliding window on the door.

SUMMARY OF THE INVENTION

According to the present invention, there is provided a window regulator comprising a first guide defining the route of a sliding window; a first slide connected in sliding manner to said first guide; actuating means connected to said first slide for moving the same along said first guide; and means for connecting said first slide to said window and moving said window along said first guide by virtue of said actuating means; characterised by the fact that said actuating means comprise a support fixed in relation to said first guide; an actuating arm mounted on said support so as to rotate in relation to the same about a first axis lying substantially crosswise in relation to said first guide, a portion of said arm defining a second guide extending along a second axis lying substantially crosswise in relation to said first axis and said first guide; and a second slide supported on said first slide and connected in sliding manner to said second guide.

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 1:
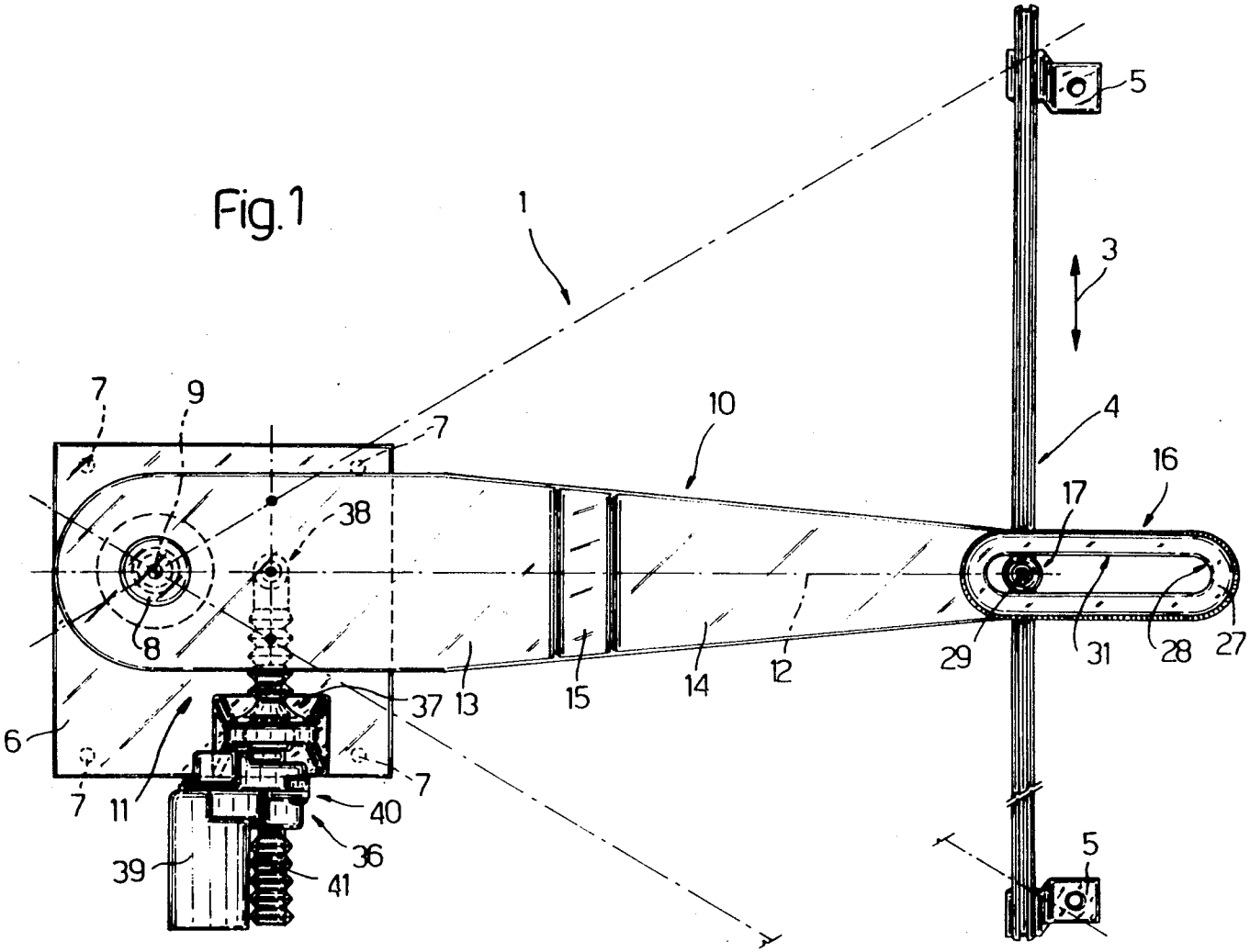
FIG. 1 shows a front view of a preferred embodiment of the window regulator according to the present invention.
Figure 2:
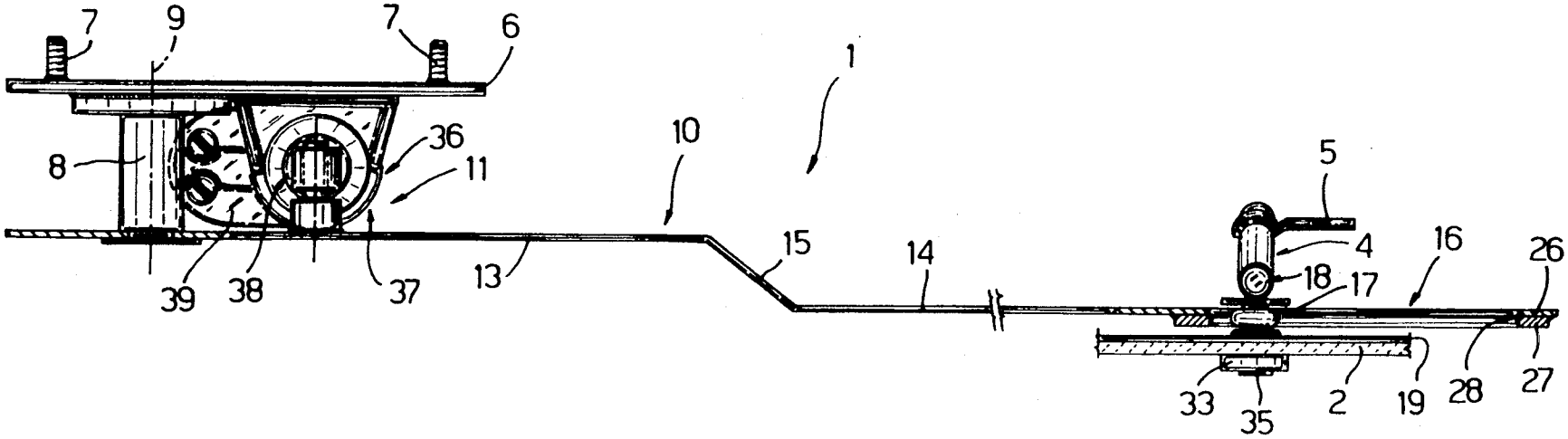
FIG. 2 shows a top view of the FIG. 1 regulator.

FIG. 1 shows a window regulator 1 suitable for being fitted inside a door (not shown) of a vehicle (not shown), particularly a motor vehicle, for regulating the position of a window 2 (FIG. 2) sliding in the direction of arrow 3 along a guide 4 fitted inside the door by means of brackets 5.

Regulator 1 comprises a substantially square plate 6 located on one side of an intermediate portion of guide 4, and secured to the door by screws 7. Plate 6 is fitted with a pin 8 having an axis 9 extending perpendicular to plate 6 and to arrow 3, and the free end of which supports for rotation an actuating arm 10 of an actuating device indicated as a whole by 11.

Arm 10 consists of a relatively thin, elongated plate having a longitudinal axis 12, when projected onto a plane perpendicular to axis 9, and comprising two end portions 13 and 14 parallel to each other and to plate 6 and connected by an inclined intermediate portion 15 for rendering arm 10 highly flexible in the plane defined by axes 9 and 12.

Figure 4:
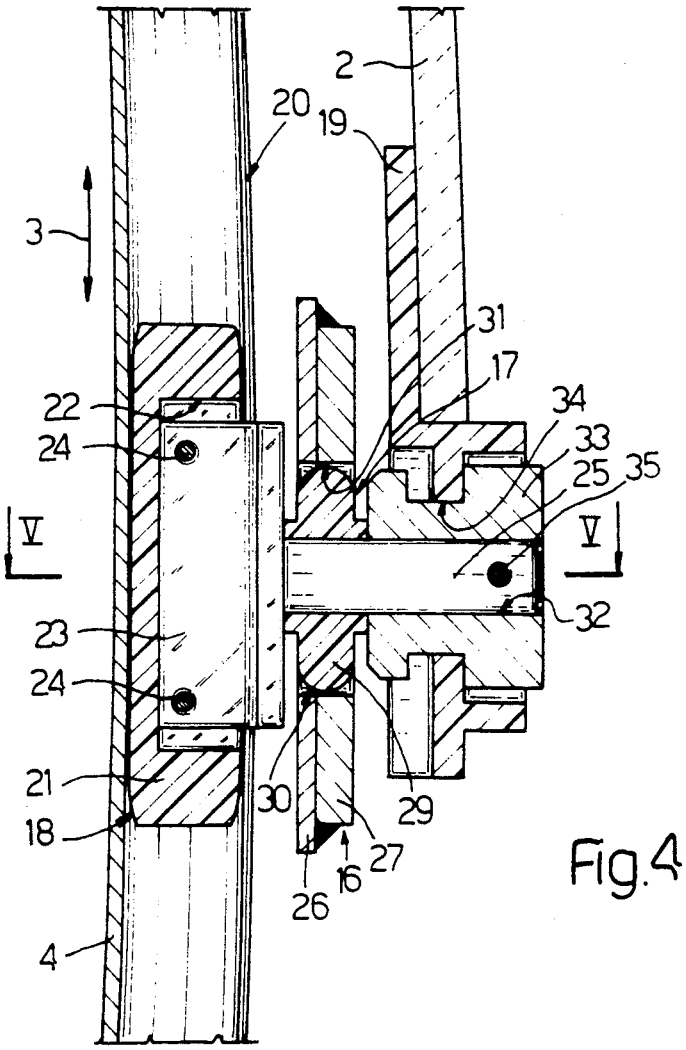
FIG. 4 shows a larger-scale section of a detail in FIG. 1.

Arm 10 is connected to pin 8 by portion 13, and is fitted, on the free end of portion 14, with a guide 16 for a slide 17 sliding along guide 16 in the direction of axis 12 and, as shown in FIG. 4, integral with both a slide 18 connected to guide 4, and a bracket 19 connected to the bottom edge of window 2.

Figure 5:
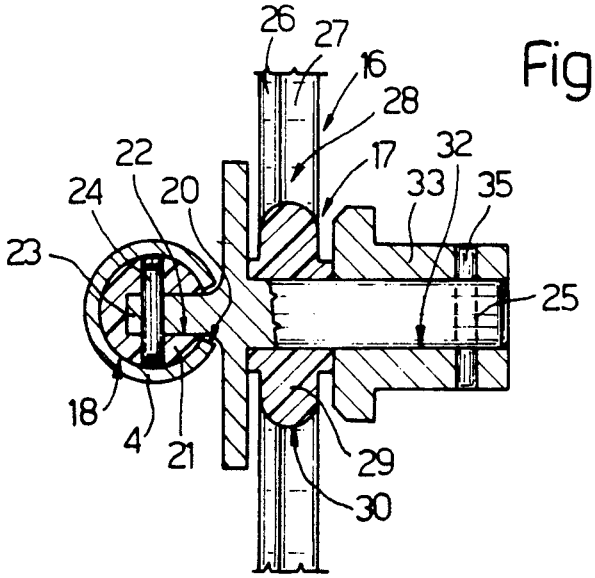
FIG. 5 shows a section along line V—V in FIG. 4.
Figure 3:
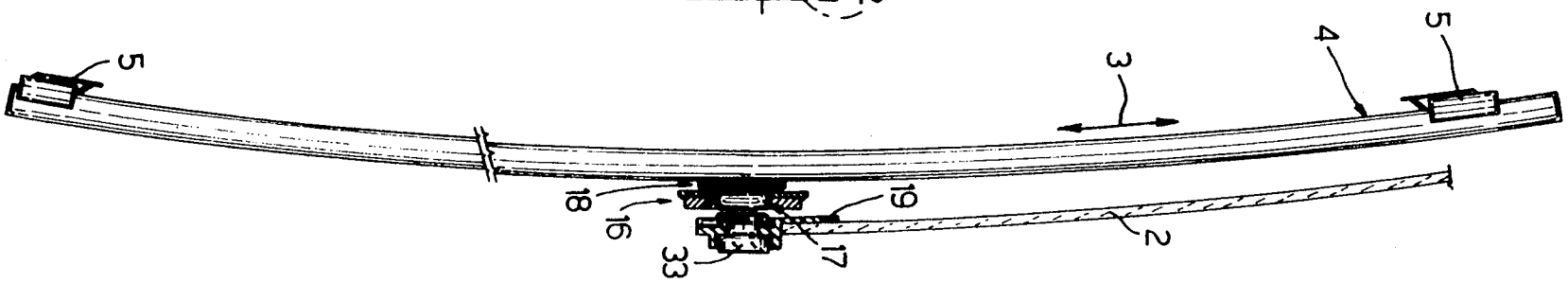
FIG. 3 shows a side view of the FIG. 1 regulator.

As shown in FIGS. 3, 4 and 5, guide 16 extends in front of and substantially crosswise in relation to guide 4, which presents a curved axis of the same curvature as the door, and comprises a cylindrical channel fitted on the ends with brackets 5 and having a longitudinal opening 20 facing guide 16.

As shown in FIGS. 4 and 5, slide 18 comprises a cylindrical body 21 engaged in sliding manner inside the channel of guide 4, and having a longitudinal diametrical recess 22 engaged by a key 23 fitted inside cylindrical body 21 by means of a transverse pin 24. Key 23 projects outwards of cylindrical body 21 to engage opening 20 in a sliding manner, and is fitted integral with a pin 25 extending radially outwards in relation to cylindrical body 21 and parallel to axis 9.

As shown in FIGS. 1, 4 and 5, guide 16 comprises an elongated plate defined by two superimposed plates 26 and 27, plate 26 being integral and coplanar with portion 14 of arm 10, and by an opening 28 extending along axis 12.

As shown particularly in FIGS. 4 and 5, slide 17 comprises a roller 29 housed inside opening 28 and mounted in idle manner on pin 25. Roller 29 presents a convex outer profile 30, the diametrically opposite points of which contact the longitudinal edges 31 of opening 28.

As shown in FIGS. 4 and 5, pin 25 extends beyond roller 29, and engages an axial through hole 32 in a cylindrical body 33 extending in rotary manner through a hole 34 (FIG. 4) in bracket 19 and fitted onto pin 25 by a diametrical pin 35.

As shown in FIG. 1, in addition to actuating arm 10, actuating device 11 also comprises an electromechanical linear actuator 36 located between plate 6 and portion 13 of actuating arm 10, and connected to plate 6 and portion 13 via respective spherical joints 37 and 38.

Linear actuator 36 comprises an electric motor 39 and a recirculating-ball, screw-nut screw drive 40 in turn comprising a screw 41 connected to portion 13 of actuating arm 10 by spherical joint 38, and moved axially by motor 39 so as to turn actuating arm 10 about axis 9 and so move slide 18, bracket 19 and window 2 along guide 4 in the direction of arrow 3, and at the same time move slide 17 along opening 28 in guide 16.

As the axis of guide 4 is curved and the rotation axis 9 of arm 10 fixed, displacement of slide 18 along guide 4 obviously results in arm 10 being subjected to both a twisting moment about axis 12 and a bending moment in the plane defined by axes 9 and 12.

Said twisting moment is absorbed by virtue of the connection between longitudinal edges 31 of opening 28 and roller 29, the convex outer profile 30 of which allows it to roll freely about axis 12 inside opening 28; while the bending moment is absorbed directly by arm 10 flexing in the plane defined by axes 9 and 12.

Figure 6:
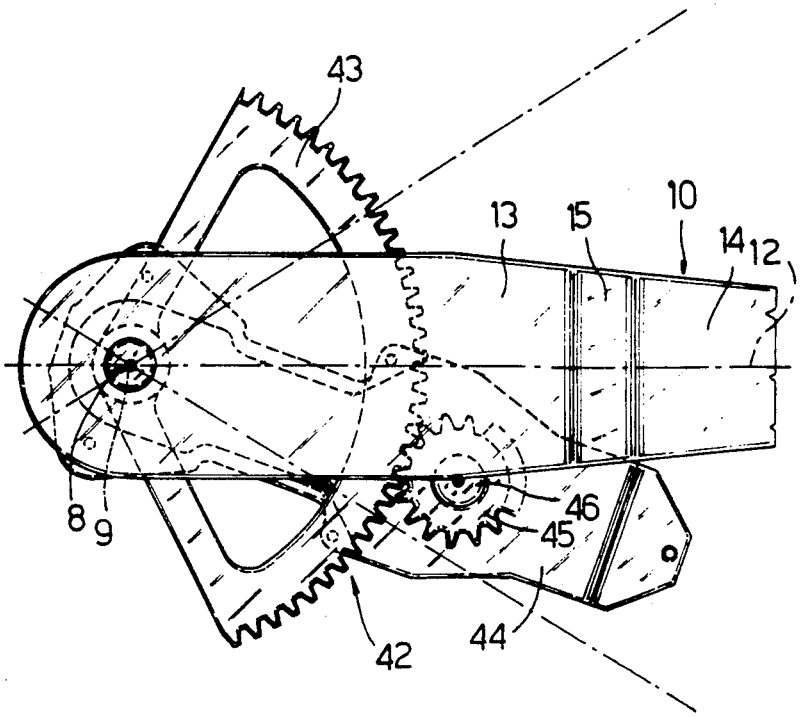
FIG 6 shows a variation of a detail in FIG. 1.

In the FIG. 6 variation, actuating device 11 is replaced by an actuating device 42 comprising, in place of linear actuator 36, a sector gear 43 connected integral with arm 10 and mounted for rotation, with arm 10, on pin 8. Pin 8 is integral with an elongated plate 44 fitted to the vehicle door in place of plate 6, and located on the opposite side of sector gear 43 in relation to arm 10. In addition to sector gear 43, actuating device 42 also comprises a pinion 45 meshing with sector gear 43 and fitted to a shaft 46 supported by plate 44 and rotated by any type of activating device (not shown), e.g. a hand-operated crank (not shown) fitted to shaft 46.

I claim:

1. A window regulator comprising:

a) a first guide for defining a path of a sliding window;

b) a first slide slidably connected to said first guide;

c) means for connecting said first slide to a window;

d) actuating means connected to said first slide for moving said first slide and a window connected thereto along said path;

e) said actuating means including a support fixed relative to said first guide, and an actuating arm rotatably mounted on said support for rotation about a first axis extending transversely relative to said first guide;

f) a second guide disposed on a first portion of said actuating arm;

g) said second guide defining a second axis extending transversely relative to said first axis and to said first guide;

h) a second slide supported on said first slide;

i) means for slidably connecting said second slide to said second guide for causing said second slide to slide relative to said second guide and along said second axis; and j) means for rotatably connecting said second slide to said second guide for causing said second slide to rotate relative to said second guide and about said second axis.

2. A window regulator as defined in claim 1, wherein:

a) said second guide includes means for defining an opening through said first portion of said actuating arm, said opening having an axis parallel to said second axis;

b) said second slide includes a roller disposed in said opening; and c) said roller includes a convex outer profile and an axis substantially parallel to said first axis.

3. A window regulator as defined in claim 1, wherein:

a) said actuating arm includes a second portion spaced apart from said first portion; and b) means for resiliently connecting said first portion and said second portion for causing said actuating arm to resiliently deform in a plane defined by the first and second axes.

4. A window regulator as defined in claim 1, wherein:

a) said first guide includes a substantially cylindrical channel having a longitudinal opening;

b) said first slide includes a substantially cylindrical body extending parallel to said first guide and axially slidably received in said cylindrical channel; and c) said substantially cylindrical body includes an integrally attached key means extending through and slidable relative to said longitudinal opening.

5. A window regulator as defined in claim 4, wherein:

a) said first guide includes a curved axis.

6. A window regulator as defined in claim 4, wherein:

a) said second slide is integrally attached to said key means.

7. A window regulator as defined in claim 1, wherein:

a) said actuating arm includes a second portion spaced apart from said first portion; and b) said actuating means includes a linear actuator disposed between said support and said second portion, said linear actuator engaging said actuating arm at a point between said first axis and said second guide.

8. A window regulator as defined in claim 7, wherein:

a) spherical joints are disposed between said support and said actuating arm, said spherical joints connecting said support to said actuating arm.

9. A window regulator as defined in claim 7, wherein:

a) said linear actuator is electromechanical.

10. A window regulator as defined in claim 9, wherein:

a) said linear actuator includes a motor and a recirculating-ball screw-nut screw drive; and b) said recirculating-ball screw-nut screw drive includes a screw connected to said second portion of said actuating arm, said screw being moved axially by said motor for causing said actuating arm to rotate about said first axis.

11. A window regulator as defined in claim 1, wherein:

a) said actuating means includes a sector gear and a pinion;

b) said pinion meshes with said sector gear and is rotatably attached to said support; and c) said sector gear rotates with said actuating arm about said first axis.

12. A window regulator comprising:

a) a first guide for defining a path of a sliding window;

b) said first guide including a substantially cylindrical channel having a longitudinal opening;

c) a first slide slidably connected to said first guide;

d) said first slide including a substantially cylindrical body extending parallel to said first guide and axially slidably received in said cylindrical channel;

e) said substantially cylindrical body including an integrally attached key means extending through and slidable relative to said longitudinal opening.

f) means for connecting said first slide to a window;

g) actuating means connected to said first slide for moving said first slide and a window connected thereto along said path;

h) said actuating means including a support fixed relative to said first guide, and an actuating arm rotatably mounted on said support for rotation about a first axis extending transversely relative to said first guide;

i) a second guide disposed on a first portion of said actuating arm;

j) said second guide defining a second axis extending transversely relative to said first axis and to said first guide; and k) a second slide supported on said first slide.

13. A window regulator as defined in claim 12, wherein:

a) said first guide includes a curved axis.

14. A window regulator as defined in claim 12, wherein:

a) said second slide is integrally attached to said key means.

15. A window regulator as defined in claim 12, wherein:

a) said actuating arm includes a second portion spaced apart from said first portion; and b) said actuating means includes a linear actuator disposed between said support and said second portion, said linear actuator engaging said actuating arm at a point between said first axis and said second guide.

16. A window regulator as defined in claim 15, wherein:

a) spherical joints are disposed between said support and said actuating arm,said spherical joints connecting said support to said actuating arm.

17. A window regulator as defined in claim 15, wherein:

a) said linear actuator includes a motor and a recirculating-ball screw-nut screw drive; and b) said recirculating-ball screw-nut screw drive includes a screw connected to said second portion of said actuating arm, said screw being moved axially by said motor for causing said actuating arm to rotate about said first axis.

18. A window regular as defined in claim 12, wherein:

a) said actuating means includes a sector gear and a pinion;

b) said pinion meshes with said sector gear and is rotatably attached to said support; and c) said sector gear rotates with said actuating arm about said first axis.

19. A window regulator comprising:

a) a first guide for defining a path of a sliding window;

b) a first slide slidably connected to said first guide;

c) means for connecting said first slide to a window;

d) actuating means connected to said first slide for moving said first slide and a window connected thereto along said path;

e) said actuating means including a support fixed relative to said first guide, and an actuating arm rotatably mounted on said support for rotation about a first axis extending transversely relative to said first guide;

f) said actuating arm including a first portion and a second portion spaced apart from said first portion;

g) a second guide disposed on said first portion of said actuating arm;

h) said actuating means including a linear actuator disposed between said support and said second portion, said linear actuator engaging said actuating arm at a point between said first axis and said second guide;

i) said linear actuator being electromechanical and including a motor and a recirculating-ball screw-nut screw drive;

j) said recirculating-ball screw-nut screw drive including a screw connected to said second portion of said actuating arm, said screw being moved axially by said motor for causing said actuating arm to rotate about said first axis;

k) said second guide defining a second axis extending transversely relative to said first axis and to said first guide; and l) a second slide supported on said first slide.

20. A window regulator comprising:

a) a first guide for defining a path of a sliding window;

b) a first slide slidably connected to said first guide;

c) means for connecting said first slide to a window;

d) actuating means connected to said first slide for moving said first slide and a window connected thereto along said path;

e) said actuating means including a support fixed relative to said first guide, and an actuating arm rotatably mounted on said support for rotation about a first axis extending transversely relative to said first guide;

f) a second guide disposed on a first portion of said actuating arm;

g) said second guide defining a second axis extending transversely relative to said first axis and to said first guide;

h) a second slide supported on said first slide;

i) means for slidably connecting said second slide to said second guide for causing said second slide to slide relative to said second guide and along said second axis;

j) means for rotatably connecting said second slide to said second guide for causing said second slide to rotate relative to said second guide and about said second axis;

k) said second guide including means for defining an opening through said first portion of said actuating arm, said opening having an axis parallel to said second axis;

l) said second slide including a roller disposed in said opening;

m) said roller including a convex outer profile and an axis substantially parallel to said first axis;

n) said opening including flat edges defining a perimeter thereof; and o) said convex outer profile of said roller engaging said flat edges.

* * * * *